United States Patent [19]

Snowdon et al.

[11] 4,023,885

[45] May 17, 1977

[54] ELECTRICAL TERMINAL

[75] Inventors: Albert C. Snowdon, Shorewood; William G. Dennison, Cedarburg, both of Wis.

[73] Assignee: Cutler-Hammer, Inc., Milwaukee, Wis.

[22] Filed: Nov. 21, 1975

[21] Appl. No.: 634,246

[52] U.S. Cl. ..... 339/278 R; 200/275; 335/196; 339/111

[51] Int. Cl.² ..... H01H 1/06; H01R 3/00

[58] Field of Search ..... 200/275, 279; 339/256 R, 276 T, 176, 111, 12 R, 12 G; 335/196

[56] References Cited

UNITED STATES PATENTS

| | | | |
|---|---|---|---|
| 3,699,504 | 10/1972 | Huber | 339/276 T X |
| 3,754,203 | 8/1973 | Pauza et al. | 339/256 R X |

*Primary Examiner*—Roy Lake
*Assistant Examiner*—E. F. Desmond
*Attorney, Agent, or Firm*—Hugh R. Rather; William A. Autio; Michael E. Taken

[57] ABSTRACT

An electrical terminal having a looped configuration for properly orienting a segment of the terminal to which a contact may be mounted to thereby properly direct a magnetic blow-out force induced by current flow through said segment. The terminal is formed by two longitudinal, parallel 90° bends rather than two lateral, parallel 90° bends, and comprises a flat rectangular member having a U-shaped aperture formed longitudinally therein defining a tongue segment (to which a contact may be mounted) spaced between a pair of longitudinal side segments joined at their ends by a pair of lateral segments bent 90° from the plane of said tongue segment about longitudinal axes co-linear with the legs of the U-shaped aperture.

15 Claims, 5 Drawing Figures

Fig. 1
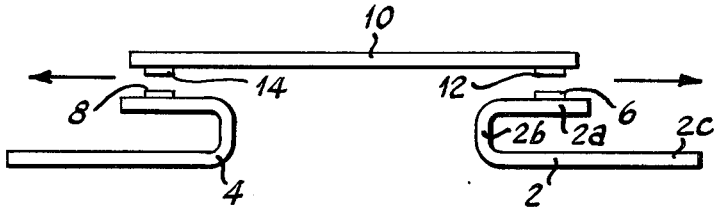
Fig. 2
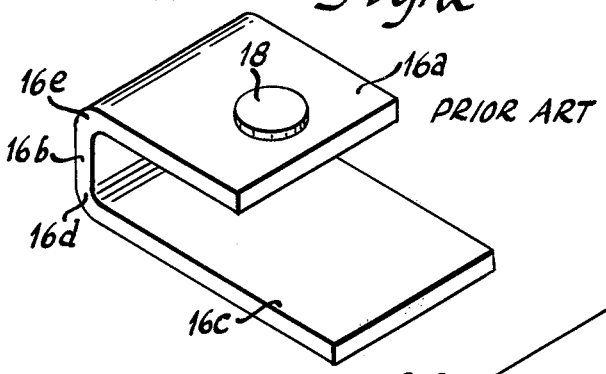
Fig. 3
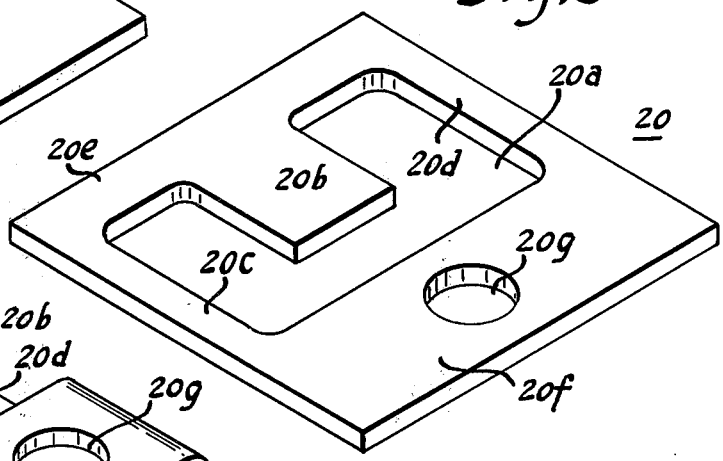
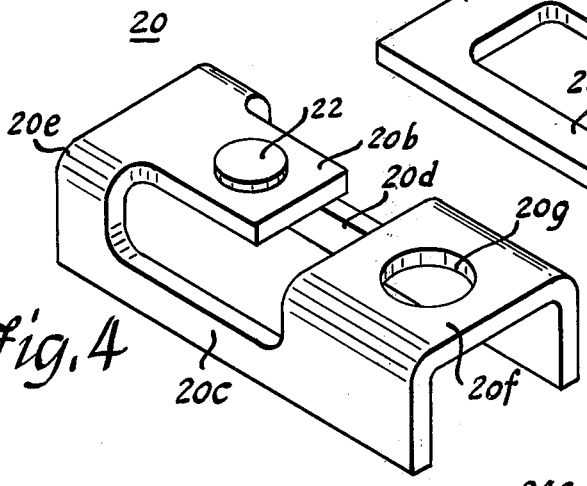
Fig. 4
Fig. 5
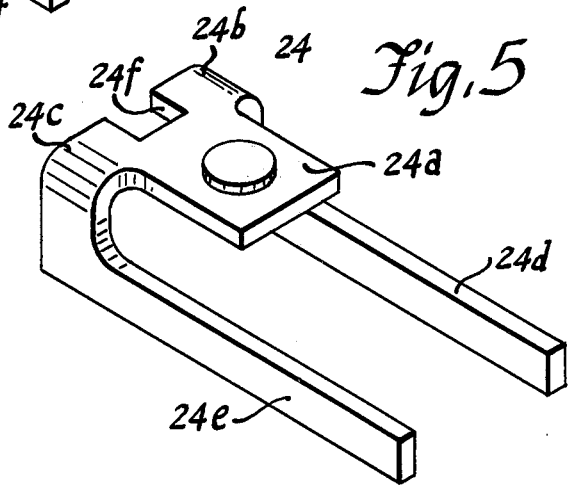

ELECTRICAL TERMINAL

BACKGROUND OF THE INVENTION

Terminals having a turned-back configuration are known in the prior art and are typically formed by a pair of lateral, parallel 90° bends in a longitudinal, flat rectangular electrically conductive member. These prior terminals are generally called "turn-back" terminals. In some applications it is desirable that the terminal segment to which a contact is mounted be oriented in a specified direction so that current flow therethrough will induce a specifically directed magnetic blow-out force upon separation of contacts. For example, in certain electromagnetic contactors, relays and the like, it is found that spatial relation of parts, ease of wiring, etc., may dictate the use of a terminal having a turned-back configuration in order to provide a properly directed and oriented terminal segment to which a contact may be mounted.

"Turn-back" terminals have been useful in properly orienting a current path, but they have been subject to tolerance deviations in bending and contact attachment and sizing, thus affecting the point of contact tripping, as will be more fully described hereinafter. The present invention eliminates these and other disadvantages while still providing a requisitely oriented terminal segment.

SUMMARY OF THE INVENTION

An object of the invention is to provide an improved contact terminal having a looped configuration whereby to afford a terminal segment having a desired orientation.

Another object of the invention is to provide a terminal of the aforementioned character affording a more accurately predetermined point of contact tripping than heretobefore achievable.

Another object of the invention is to provide a terminal of the aforementioned character affording accurate spacial location of that segment of the terminal to which a contact may be mounted.

Another object of the invention is to provide a terminal of the aforementioned character affording accurate contact attachment.

Another object of the invention is to provide a terminal of the aforementioned character affording accurate contact sizing.

Another object of the invention is to provide a terminal of the aforementioned character affording a greater magnetic blow-out force.

Other objects and advantages will hereinafter appear.

BRIEF DESCRIPTION OF THE DRAWINGS

FIG. 1 is a schematic illustration showing one use of the prior "turn-back" terminal shown in FIG. 2 and also showing a use of the present invention when substituted for the terminals shown therein.

FIG. 2 is an isometric view of a prior "turn-back" terminal.

FIG. 3 is an isometric view of an embodiment of the present invention in an intermediate stage of manufacture before bending.

FIG. 4 is a view like FIG. 3, but of a completed terminal after bending, with a contact attached.

FIG. 5 is an isometric view of an alternate embodiment of the present invention.

DESCRIPTION OF THE PRIOR ART

There is shown in FIG. 1 a schematic illustration of a typical bridging arrangement used in electromagnetic contactors, relays and the like. A pair of stationary looped terminals 2 and 4 have contacts 6 and 8 mounted thereon bridged from above by a vertically reciprocal member 10 having contacts 12 and 14 mounted thereon and engageable with contacts 6 and 8, respectively, to complete a circuit between the terminals.

The looped configuration is desirable because it provides a properly oriented terminal segment 2*a* through which a current flow will induce a requisitely directed magnetic field to blow-out contact arcing in the direction shown by the arrows in FIG. 1 into arc chutes or the like (not shown). When bridging member 10 is in its downward position, current entering at terminal 2 will flow leftwardly through segment 2*c*, then upwardly through segment 2*b*, then rightwardly through segment 2*a*, then upwardly through contacts 6 and 12, then leftwardly through bridging member 10, and so on. The current loop formed by the segment 2*a*, the contacts 6 and 12, and the right side of bridging member 10 produces a magnetic field directed out of the page as viewed in FIG. 1. When the bridging member 10 moves upward, separating the contacts, there may be continued current flow between the contacts 6 and 12 through the air gap therebetween, known as contact arcing. Since this remaining current flow is directed upwardly and since the magnetic field is directed out of the page, FIG. 1, there will, therefore, according to Fleming's left hand rule, be a force produced on the arc tending to push it to the right, FIG. 1.

There is also a magnetic field produced by the loop 2*c*, 2*b* and 2*a*, and directed into the page, FIG. 1, which tends to push any contact arcing to the left. The strength of this field, however, is less than that of the first mentioned field due to the greater distance between segments 2*c* and 2*a* than between 2*c* and 10. Also, the first mentioned field is in closer proximity to the arc. Thus the first mentioned field will dominate and produce a net rightward force on any arc between the contacts.

There is shown in FIG. 2 a metal "turn-back" terminal 16 known in the prior art which may be used as shown in FIG. 1. This terminal has an upper longitudinal, horizontal segment 16*a* having a contact 18 mounted thereon, a middle vertical segment 16*b*, and a lower longitudinal, horizontal segment 16*c*. These segments are formed by lateral, parallel 90° bends 16*d* and 16*e* in the terminal about axes perpendicular to the direction of current flow to thereby effect a turned-back configuration. Segment 16*c* is rigidly mounted to a housing (not shown) for seating the terminal.

The accuracy of the vertical distance between segments 16*c* and 16*a* is controlled by the accuracy of the bends 16*d* and 16*e*. These bends may be formed by using a rectangular steel bar, known as a horn, and bending the terminal there around to form segments 16*a*, 16*b* and 16*c*. After removal of the horn, however, segments 16*a* and 16*c* must be bent slightly further in order for them to return to a horizontal position upon relaxation due to inherent elasticity of the metal terminal. A slight deviation from 90° in either of the bends can cause substantial deviation in the point of contact closure when the terminal is used as shown in FIG. 1.

Contact 18 is commonly spot welded or stamped on segment 16*a* by an impulsive force and this requires a firm backing beneath segment 16*a*. The strength of such a backing is limited by the physical size thereof because only a cantilever or rail can be used due to the limited access from below. After attachment, contact 18 is commonly "sized" by one or more hammer blows of an impulsive force to reduce its vertical height to a desired dimension. This sizing process, however, is hampered by the limited strength of the backing wherein a cantilever or rail may break off or crack, etc., under the stress of repeated force impulse strokes. Thus, contact attachment and/or sizing may cause further tolerance deviation, rendering less accurate the vertical location of the top surface of contact 18.

It is thus seen that while a "turn-back" terminal is desirable for blow-out purposes, it also introduces tolerance problems in terminal bending and contact attachment and sizing which decrease the accuracy obtainable in the vertical positioning of the contact, thus causing deviation in the point of contact closure.

DESCRIPTION OF THE PREFERRED EMBODIMENT

There is shown in FIGS. 3 and 4 a looped terminal providing extremely accurate vertical dimension control and improved magnetic blow-out characteristics. Referring to FIG. 3, there is provided a flat electrically conductive metal terminal 20 having a U-shaped aperture 20*a* formed longitudinally therein defining a longitudinal tongue segment 20*b* spaced between a pair of longitudinal side segments 20*c* and 20*d* jointed at their ends by a pair of opposite lateral end segments 20*e* and 20*f*. This embodiment may also be described as an integral terminal comprising an E-shaped portion having a longitudinal middle segment 20*b* disposed between a pair of longitudinal side segments 20*c* and 20*d*, and comprising an end segment 20*f* longitudinally spaced from and co-planar with segment 20*b* and extending between segments 20*c* and 20*d*. A circular aperture 20*g* is formed in end segment 20*f* for mounting and/or electrical connection purposes.

The flat terminal shown in FIG. 3 is longitudinally placed over a channel die, narrower is width than the terminal, and punched from above into the channel by a forming punch to make two longitudinal, parallel 90° bends spaced from its edges to prodice the channel-like configuration shown in FIG. 4 wherein the side segments 20*c* and 20*d* lie in parallel planes substantially perpendicular to the plane of tongue segment 20*b*, and wherein the edges of side segments 20*c* and 20*d* lie in a plane substantially parallel to the plane of tongue segment 20*b*. A contact 22 is mounted to the tongue segment and hence current entering centrally at end segment 20*f* flows in two paths laterally outward in opposite directions into the bends, then down and longitudinally leftwardly along side segments 20*c* and 20*d*, then up into the bends, then inwardly along end segment 20*e*, then rightwardly along tongue segment 20*b*, and then up through contact 22.

It is thus seen that terminal 20 may be used as shown in FIG. 1. Terminal 20 may be mounted by seating the bottom edges of side segments 20*c* and 20*d* on a flat horizontal surface. As shown in FIG. 4, a deviation from 90° in the bends of the terminal will not affect the vertical distance between tongue segment 20*b* and said horizontal surface as much as a similar deviation from 90° in the bends 16*d* and 16*e* of terminal 16, FIG. 2, will affect the vertical distance between segment 16*c* and segment 16*a*. There is thus afforded an accurately predetermined distance between tongue segment 20*b* and the plane containing the edges of side segments 20*c* and 20*d*, thereby enhancing the accuracy of a predetermined point of contact tripping, FIG. 1.

Terminal 20 may also be mounted for use as shown in FIG. 1 by seating tongue segment 20*b* and the central parts of end segments 20*e* and 20*f* against a flat horizontal surface extending longitudinally therebeneath between side segments 20*c* and 20*d*, or alternatively by only seating end segment 20*f* through aperture 20*g*. Tongue segment 20*b* and the central parts of end segments 20*e* and 20*f* are co-planar and not affected by the bends, thus affording accurate vertical dimension control of tongue segment 20*b* and enhancing the accuracy of a predetermined point of contact tripping.

Terminal 20 also provides access from below whereby a firm backing may be used beneath tongue segment 20*b* during contact attachment and sizing. Due to the free access from below, the backing is not limited to a rail or cantilever as before, hence allowing a stronger backing, thus decreasing tolerance deviations in the vertical location of the top surface of contact 22. Furthermore, this free access from below allows the contact to be mounted on the underside of tongue segment 20*b* if so desired for certain circuit applications.

It is thus seen that the vertical dimension tolerance deviation errors introduced by the parameters of terminal bending and contact attachment and sizing are substantially diminished by the present invention embodying the concept of using longitudinal bends rather than lateral bends in a longitudinally-looped contact terminal.

It is also to be noted that terminal 20 provides a greater magnetic blow-out force than terminal 16. This is so because segments 20*c* and 20*d*, FIG. 4, are not only vertically spaced from tongue segment 20*b*, but also laterally spaced therefrom; hence the distance between tongue segment 20*b* and side segments 20*c* and 20*d* is greater than the distance between segments 16*a* and 16*c*, FIG. 2. Thus, terminal 20, when used as terminal 2 in FIG. 1, produces a weaker magnetic field into the page, which in turn causes a lesser leftward force, resulting in a greater net rightward force on any arc between contacts 6 and 12, FIG. 1, than if terminal 16 where used as terminal 2 in FIG. 1.

Though FIG. 4 shows bends of substantially 90°, other degrees of bending are possible, especially if terminal 20 is mounted by end segment 20*f*. 90° bends are preferred because they increase the structural strength of the terminal.

The present invention essentially comprises the conception of using bends about longitudinal axes rather than lateral axes in a longitudinally-looped terminal, and hence encompasses numerous other possible embodiments. For example, there is shown in FIG. 5 an integral flat E-shaped member 24 having a longitudinal middle segment 24*a*, a pair of lateral segments 24*b* and 24*c* extending therefrom, and a pair of longitudinal outer segments 24*d* and 24*e* extending from the lateral segments parallel to the middle segment. Each of the lateral segments is bent 90° from the plane of middle segment 24*a* about longitudinal axes such that the side segments lie in parallel planes substantially perpendicular to the plane of the middle segment and such that the plane containing the edges of the side segments is substantially parallel to the plane of the middle segment.

This terminal is further provided with a notch 24*f*, FIG. 5, in the middle segment intermediate the lateral segments. Thus, when terminal 24 is used as terminal 2 in FIG. 1, the notch diverts the inward current flow from the bends towards the right, thus providing a greater net rightwardly directed current flow through middle segment 24*a* to thereby increase the magnetic blow-out force. It can easily be appreciated that such a notch can also be provided in the terminal of FIG. 4 to accomplish similar results.

The present invention is not limited to the use shown in the schematic illustration of FIG. 1, but is adaptable for other applications wherein a terminal having a looped configuration is desired in order to properly orient a terminal segment.

We claim:

1. An integral electrical contact terminal comprising a generally E-shaped portion comprising;

a longitudinal horizontally planar middle segment flat throughout its length and having a contact mounted thereto for engagement by another contact mounted to a conductor such that current flow rightwardly through said middle segment then vertically through said contacts then leftwardly through said conductor forms a current loop which induces a magnetic field exerting a longitudinally directed blow-out force on arcing between said contacts;

a pair of lateral segments extending frontwardly and rearwardly from opposite front and rear sides of the left end of said middle segment; and a pair of longitudinal outer segments extending rightwardly from said lateral segments;

each of said lateral segments being bent downwardly about a longitudinal axis such that current flow leftwardly through said outer segments is directed upwardly and laterally inwardly through said lateral segments to meet at said middle segment and flow rightwardly therethrough, said bends about said longitudinal axes providing accurate establishment of the vertical height of said middle segment above said outer segments to minimize tolerance deviations in the point of engagement of said contacts when said terminal is supported by said outer segments and affording open vertical access to said middle segment from both above and below during attachment of said first mentioned contact.

2. A terminal according to claim 1 wherein said lateral segments are bent to the same direction substantially 90° from the plane of said middle segment such that said outer segments lie in parallel planes substantially perpendicular to the plane of said middle segment and such that the edges of said outer segments lie in a plane substantially parallel to the plane of said middle segment.

3. A terminal according to claim 1 wherein said middle segment has a notch formed therein between said lateral segments.

4. A terminal according to claim 1 comprising;

an end segment longitudinally spaced from and coplanar with said middle segment; and a second pair of lateral segments extending from opposite sides of said end segment and bent similarly to said first mentioned pair of lateral segments to meet said outer segments.

5. A terminal according to claim 4 wherein all of said lateral segments are bent to the same direction substantially 90° from the plane of said middle segment and said end segment such that said outer segments lie in parallel planes substantially perpendicular to the plane of said middle segment and said end segment and such that the edges of said outer segments lie in a plane substantially parallel to the plane of said middle segment and said end segment.

6. A terminal according to claim 4 wherein said middle segment has a notch formed therein between said first mentioned pair of lateral segments.

7. A terminal according to claim 4 wherein said end segment has mounting means formed therein.

8. An electrical terminal comprising an integral member having a U-shaped aperture with a laterally extending horizontal bight and longitudinally extending legs formed therein defining a longitudinal horizontally planar tongue segment flat throughout its length, coplanar with said bight and spaced by said legs between a pair of longitudinal outer segments joined at their ends by a pair of lateral segments bent to the same direction substantially 90° from the horizontal about longitudinal axes co-linear with said legs.

9. An electrical contact terminal having a turned-back configuration for properly orienting a horizontally planar tongue segment of the terminal to which a contact may be mounted for engagement by another contact mounted to a conductor such that current flow rightwardly through said tongue segment then vertically through said contacts then leftwardly through said conductor forms a current loop which induces a magnetic field exerting a blow-out force on arcing between said contacts, said terminal comprising an integral member having a U-shaped aperture with a laterally extending horizontal bight and longitudinally leftwardly extending legs formed therein defining said tongue segment flat throughout its length, co-planar with said bight and spaced by said legs between a pair of longitudinally extending outer segments jointed at least at their left end by lateral segments extending laterally forwardly and rearwardly from the left end of said tongue segment and bent downwardly from the horizontal plane of said tongue segment and said bight about longitudinal axes co-linear with said legs, such that current flow longitudinally leftwardly through each of said outer segments is directed upwardly and laterally inwardly through said lateral segments to meet at said tongue segment and then flow rightwardly through said tongue segment, said bends about said longitudinal axes affording open vertical access to said tongue segment from both above and below during attachment of said first mentioned contact.

10. The terminal according to claim 9 wherein said tongue segment has a current diverting notch formed in the left end thereof.

11. The terminal according to claim 9 wherein said first mentioned contact is mounted to the top surface of said tongue segment, and wherein said lateral segments are bent downwardly substantially 90° from the horizontal to provide means for accurately establishing the vertical height of said tongue segment above said outer segments to thereby minimize tolerance deviations in the point of engagement of said contacts when said terminal is supported on said outer segments.

12. The terminal according to claim 11 wherein said tongue segment, said contacts and said conductor from a counterclockwise current loop inducing a magnetic field exerting a rightwardly directed blow-out force, and wherein said pair of outer segments, said lateral segments and said tongue segment form a pair of clockwise current loops inducing a magnetic field exerting a leftwardly directed force on arcing between said contacts, said outer segments being laterally offset from the vertical plane of said counterclockwise current loop to thereby diminish said leftwardly directed force and enhance the net rightwardly directed magnetic blow-out force.

13. The terminal according to claim 12 comprising a flat horizontal end segment co-planar with said tongue segment and spaced longitudinally rightwardly from said tongue segment by said bight and joined to the right ends of said outer segments by lateral segments extending laterally forwardly and rearwardly from said end segment, said last mentioned lateral segments being bent downwardly substantially 90° from the horizontal about said longitudinal axes co-linear with said legs.

14. The terminal according to claim 13 wherein said end segment has a mounting hole formed therein.

15. A method for making an integral electrical contact terminal having a turned-back configuration for magnetic blow-out purposes wherein said terminal carries current longitudinally leftwardly through first portions and then longitudinally rightwardly through a second portion to which a contact may be mounted, said method comprising the steps of:

providing a flat piece of sheet metal;

forming in said piece a U-shaped aperture having a pair of longitudinally extending legs jointed by a laterally extending bight; and bending said terminal about a pair of longitudinal axes co-linear with said legs of said U-shaped aperture to provide a flat planar central portion as said second portion, co-planar with said bight of said U-shaped aperture and spaced between said first portions by said legs of said U-shaped aperture.

* * * * *

UNITED STATES PATENT AND TRADEMARK OFFICE

CERTIFICATE OF CORRECTION

PATENT NO. : 4,023,885

DATED : May, 17, 1977

INVENTOR(S) : A. C. Snowdon - W. G. Dennison

It is certified that error appears in the above-identified patent and that said Letters Patent are hereby corrected as shown below:

Column 1, line 42, reads "spacial"
should read -- spatial -- (our error)

Column 4, line 49, reads "where"
should read -- were --

Column 6, line 40, reads "jointed"
should read -- joined --

Column 6, line 41, reads "end"
should read -- ends --

Column 8, line 12, reads "jointed"
should read -- joined --

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*